US009114429B2

(12) United States Patent
Wiherle et al.

(10) Patent No.: US 9,114,429 B2
(45) Date of Patent: Aug. 25, 2015

(54) MECHANICALLY FASTENED DIGGING AND SIFTING SCOOP

(76) Inventors: Gregory Wiherle, Joppa, MD (US); Christopher Marvel, Wappinger, NY (US)

( * ) Notice: Subject to any disclaimer, the term of this patent is extended or adjusted under 35 U.S.C. 154(b) by 315 days.

(21) Appl. No.: 13/545,869

(22) Filed: Jul. 10, 2012

(65) Prior Publication Data

US 2013/0015107 A1 Jan. 17, 2013

Related U.S. Application Data

(60) Provisional application No. 61/572,085, filed on Jul. 11, 2011.

(51) Int. Cl.
*B07B 1/49* (2006.01)
*B07B 1/02* (2006.01)

(52) U.S. Cl.
CPC ..... *B07B 1/02* (2013.01); *Y10T 29/49947* (2015.01)

(58) Field of Classification Search
CPC ..... B07B 1/02; E02F 3/02; A01B 1/00
USPC ..... 209/232, 417–419
See application file for complete search history.

(56) References Cited

U.S. PATENT DOCUMENTS

| | | | | |
|---|---|---|---|---|
| 915,233 | A | 3/1909 | Smith | |
| 1,619,266 | A * | 3/1927 | Miller | 209/419 |
| 2,960,230 | A | 11/1960 | Fracker | |
| 4,979,623 | A | 12/1990 | Flanagan | |
| 7,111,741 | B2 * | 9/2006 | Bramante | 209/614 |
| 7,172,229 | B2 * | 2/2007 | Gorbet | 294/49 |
| 7,878,334 | B2 | 2/2011 | Tucker | |
| 8,016,118 | B2 * | 9/2011 | Boll | 209/417 |
| 8,695,807 | B2 * | 4/2014 | Knittel | 209/419 |
| 2006/0180512 | A1 | 8/2006 | Allen | |

OTHER PUBLICATIONS

Find's Treasure Forums. In Beach and Water / Scuba Dive Detecting Forum [online]. Re: Scoop dreams . . . I wanted a new scoop . . . Sep. 7, 2011 12:21AM [retrieved on Jul. 7, 2012] Retrieved from the Internet: <URL:http://www.findmall.com/read.php?26,1542207,1542332#msg-1542332.

Find's Treasure Forums. In Beach and Water / Scuba Dive Detecting Forum [online]. Re: Scoop dreams . . . I wanted a new scoop . . . Sep. 7, 2011 12:21AM [retrieved on Jul. 7, 2007] Retrieved from the Internet: <URL:http://www.findmall.com/read.php?26,1542207,1542332#msg-1542332.

* cited by examiner

*Primary Examiner* — Joseph C Rodriguez
*Assistant Examiner* — Kalyanavenkateshware Kumar

(57) ABSTRACT

A mechanically fastened digging and sifting scoop for digging and sifting objects from a medium is provided. The device includes a head, a means for manipulating the head, and a connection means. The connection means allows the combination of materials with different compositions to be mechanically fastened together.

6 Claims, 4 Drawing Sheets

FIG. 3
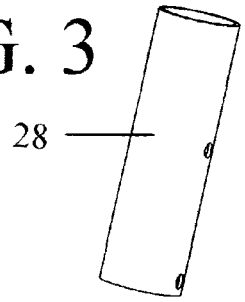
FIG. 4
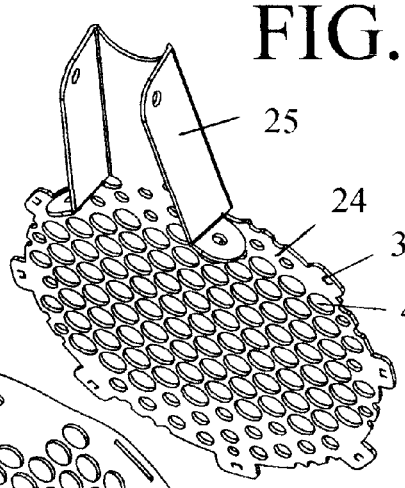
FIG. 5
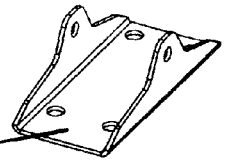
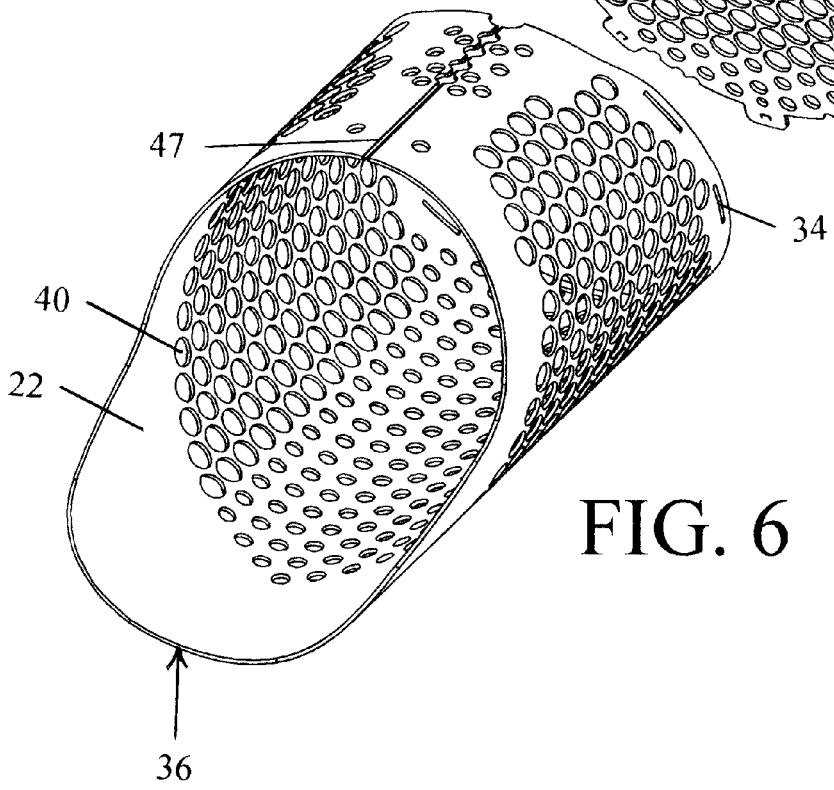
FIG. 6

FIG. 7A
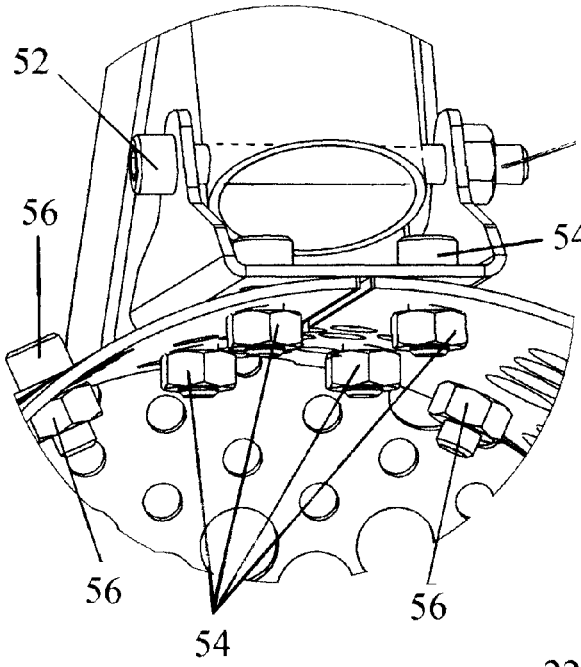
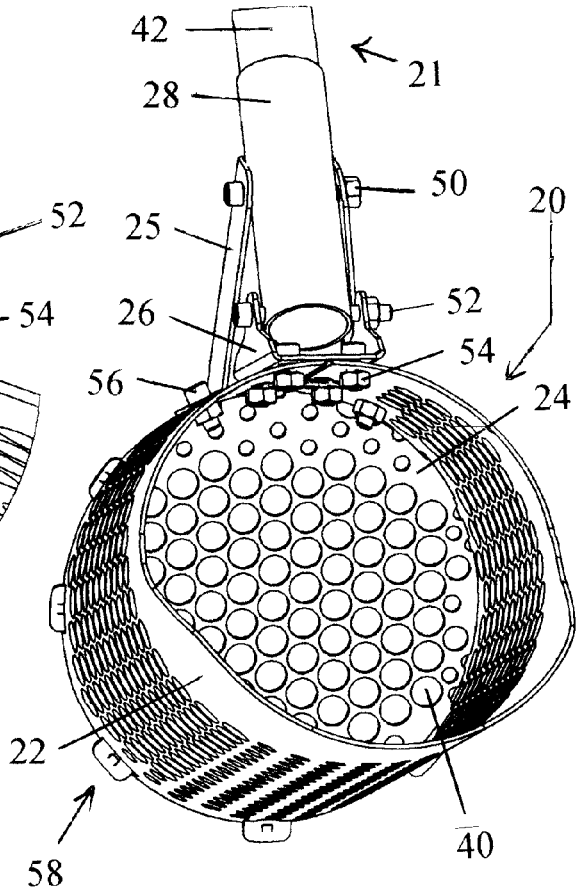
FIG. 7
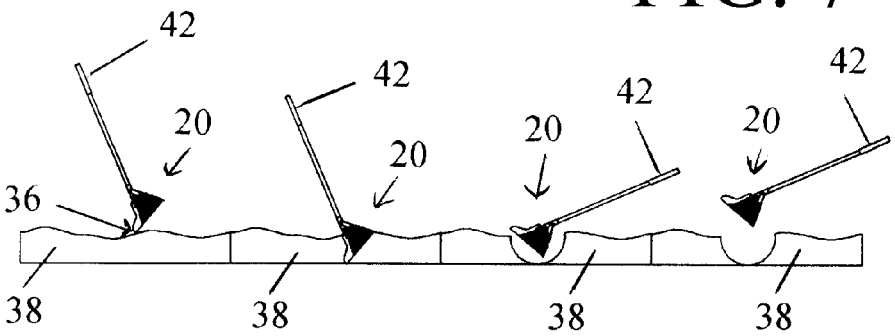
FIG. 8A FIG. 8B FIG. 8C FIG. 8D

MECHANICALLY FASTENED DIGGING AND SIFTING SCOOP

CROSS-REFERENCE TO RELATED APPLICATIONS

This patent application claims the benefit of Provisional Application Ser. No. 61/572,085, filed on Jul. 11, 2011, which is incorporated by reference in its entirety.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present embodiment relates generally to a device for excavating and separating objects from a medium in which such objects are located. In particular, the present embodiment relates to a device for digging and sifting to be used in conjunction with a metal detector.

The following is a tabulation of some prior art that presently appears relevant:

U.S Patents

| Patent Number | Kind Code | Issue Date | Patentee |
|---|---|---|---|
| 915,233 | | Mar. 16, 1909 | Smith |
| 2,960,230 | | Nov. 15, 1960 | Fracker |
| 3,976,564 | | Aug. 24, 1976 | Holder |
| 4,979,623 | | Dec. 25, 1990 | Flanagan |
| 7,878,334 | | Feb. 1, 2011 | Tucker |

U.S. Patent Application Publications

| Patent Application Number | Kind Code | Publication Date | Applicant |
|---|---|---|---|
| 20060180512 | A1 | Aug. 17, 2006 | Allen |

2. Description of Related Art

Metal detectors make it possible to quickly and easily locate buried objects which may then be retrieved. Although many devices have been developed for retrieving buried objects, there exists a need in the art for a device that is lightweight, durable and easily repairable. Prior art devices used for retrieving buried objects typically include scoops, spades, shovels, sieves and the like, however, not all of these devices are best suited to retrieving buried objects while metal detecting. Devices designed specifically for digging and sifting while engaged in the hobby of metal detecting have a scoop-like design with fully or partially welded structures.

The use of welding for assembling a scoop has significant limitations. Metals with different compositions cannot be reliably welded together. Welds in general, or the metal next to welds, are prone to fail due to fatigue.

There are numerous examples of known art disclosing scoops made specifically for retrieving buried objects while metal detecting. These scoops, while varying in shape, size, construction techniques, and use of materials, all have fully or partially welded structures. Much of the art discloses scoops with fully welded structures, while some of the art discloses partially welded structures with bolted and/or riveted on accessories. Metal detecting scoops, whether fully or partially welded, taught by the known art, all have their key structural components welded together. Key structural components are defined as those scoop parts of the known art that are currently being welded. Thus, a construction technique utilizing welding limits a scoop's key structural components to materials of the same composition. For example, the key components of a scoop constructed using a welding process should be all stainless steel composition or all aluminum composition, but not a combination of both stainless steel and aluminum composition. Aluminum alloy cannot be reliably welded to stainless steel alloy. And most high strength lightweight aluminum alloys, suitable for use as the key structural components of a scoop, cannot be reliably welded to themselves.

In addition, the key structure of a welded metal detecting scoop using materials of the same composition is subject to failure at the welded connections. Welds eventually fail due to over-load, underdesign, or fatigue as a result from the shrinkage strains that occur as the weld metal cools. When a welded scoop fails at its welded connection, the result is a weakened scoop that cannot be easily repaired by the user. Repairs to scoops that require additional welding continue to contribute to the weakening of the scoop due to the same strains that occurred as the weld metal cooled during the original weld. Some repairs even require adding more material and structure to the scoop, inherently increasing its overall weight.

BRIEF SUMMARY OF THE INVENTION

In accordance with one embodiment of the invention, a mechanically fastened digging and sifting scoop comprises a head, a means for manipulating the head, and a connection means. One embodiment is mechanically fastened by a connection means resulting in a durable and lightweight device with all components adapted to be replaceable by the user. Additionally, one embodiment of this invention allows the combination of metals with different compositions.

Advantages

Accordingly, several advantages of one or more aspects are as follows:

a) The mechanically fastened digging and sifting scoop can be constructed with materials of different composition.

b) The mechanically fastened digging and sifting scoop can combine structural components made preferably from both aluminum and stainless steel metal alloys that cannot be reliably welded together or reliably formed to shape.

c) The mechanically fastened digging and sifting scoop is less prone to fatigue failures at its connection means because it is mechanically fastened.

d) The mechanically fastened digging and sifting scoop is a lightweight and durable device.

e) Component parts of a mechanically fastened digging and sifting scoop can be easily replaced by the consumer with common household tools and without the use of expensive welding equipment.

Other advantages of one or more aspects will be apparent from a consideration of the drawings and ensuing description.

BRIEF DESCRIPTION OF THE SEVERAL VIEWS OF THE DRAWINGS

FIG. 3 is a perspective view of the tube connection plate

FIG. 4 is a perspective view of the back plate

FIG. 5 is a perspective view of the handle mounting tube

FIG. 6 is a perspective view of the skin

FIG. 7 is a perspective view of the sifting scoop and its connection means

FIG. 7A is an enlarged perspective view of the mechanical fastener details

FIGS. 8A, 8B, 8C and 8D illustrate the use of the sifting scoop

REFERENCE NUMERALS

Figure 1:
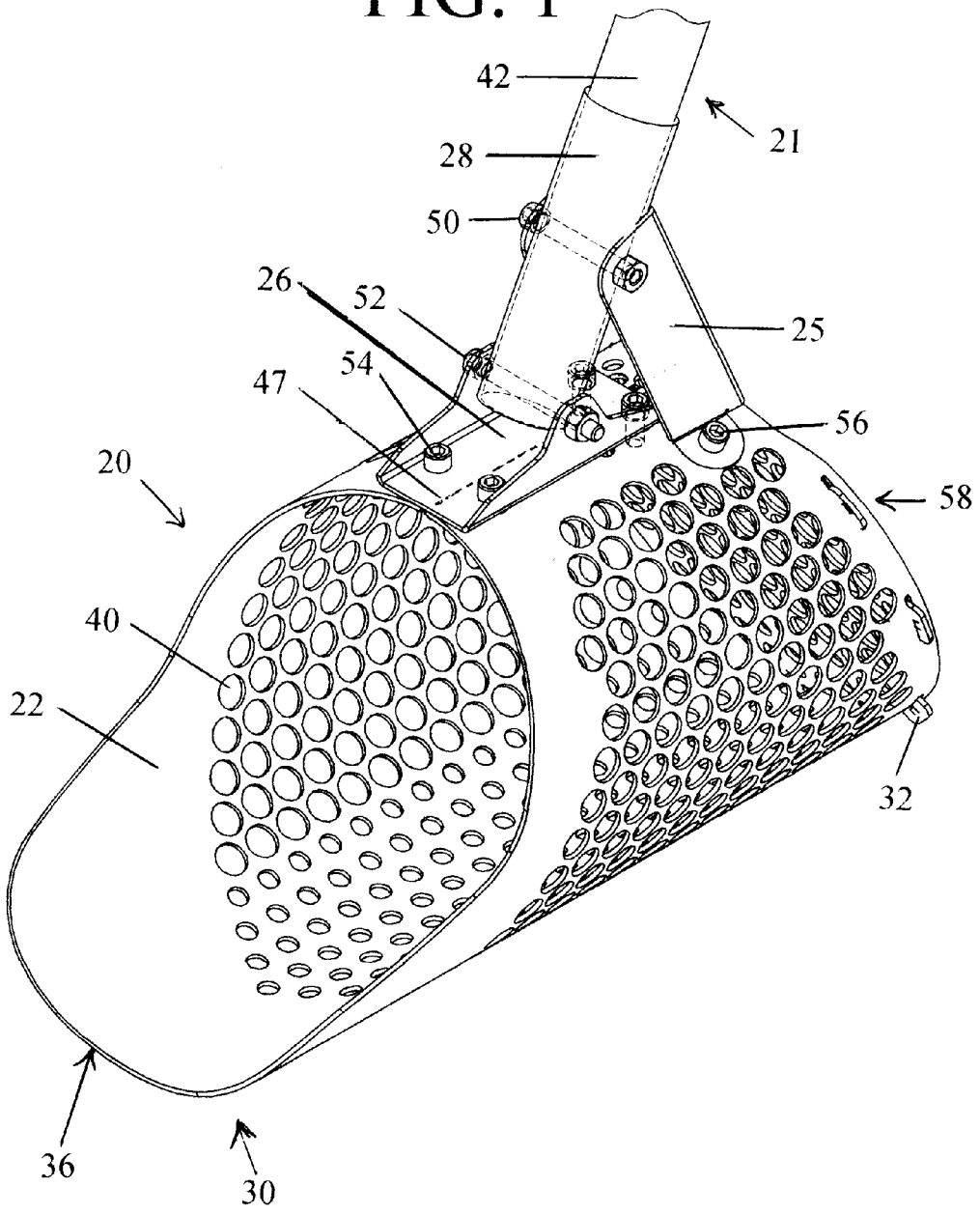
FIG. 1 is a perspective view of the scoop from a front angle

20 head
21 means for manipulating
22 skin
24 back plate
25 back plate appendage
26 tube connection plate
28 handle mounting tube
30 open end
31 closed end
32 tabs
33 mini tab
34 slots
36 penetration point
38 medium
40 sifting aperture(s)
42 handle
46 inset
47 seam
50 back plate appendage to handle mounting tube mechanical fastener
52 tube connection plate to handle mounting tube mechanical fastener
54 tube connection plate to skin mechanical fasteners
56 back plate appendage to skin mechanical fasteners
58 tab and slot mechanical fasteners

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, the specific structural and functional details disclosed herein are not to be interpreted as limiting but merely as a basis for the claims and as representative basis for teaching one skilled in the art to variously employ the present invention in virtually any appropriately detailed structure.

Figures 2, 2A, 2B:
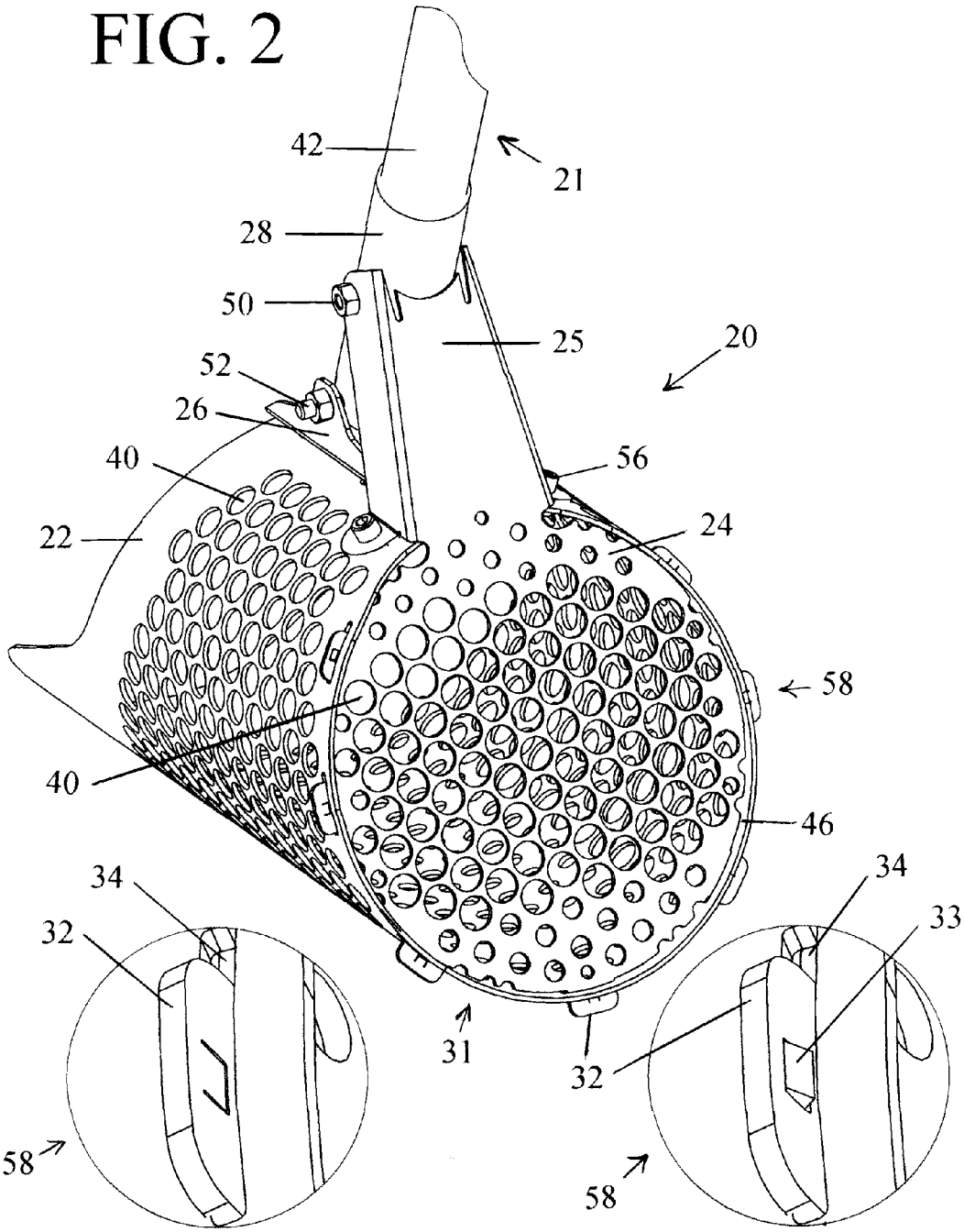
FIG. 2 is a perspective view of the scoop from a back angle
FIG. 2A is an exploded view of the tab and slot
FIG. 2B is an exploded view of the tab and slot mini tab engagement

Referring more particularly to the drawings, a mechanically fastened digging and sifting scoop in accordance with the preferred embodiment is shown generally in FIGS. 1, 2, and 7. The scoop comprises a head 20, a means 21 for manipulating head 20, a handle 42 and a connection means.

FIGS. 3-5 show connection means comprising a removably fastened assembly of replaceable components. FIG. 3 shows a handle mounting tube 28. FIG. 4 shows a back plate 24 and a back plate appendage 25. FIG. 5 shows a tube connection plate 26.

FIGS. 1, 2 and 6, show a skin 22 preferably as a one-piece cylindrical body formed from metal that is preferably 0.075 inches thick and preferably 13 inches long and preferably 6.5 inches in diameter. Skin 22 has a plurality of sifting apertures 40 where the apertures are preferably circular and have a diameter from between approximately 0.25 inches to 0.625 inches. FIG. 1 shows head 20 an open end 30. FIG. 2 shows head 20 a closed end 31.

FIGS. 2 and 4 show back plate 24 and back plate appendage 25. Back plate 24 is formed from metal that is preferably 0.075 inches thick and preferably 6.5 inches in diameter. Back plate 24 has a plurality of sifting apertures 40 where the apertures are preferably circular and have a diameter from between approximately 0.25 inches to 0.625 inches.

FIG. 2 shows a tab 32 on back plate 24 positioned into a slot 34 (shown in FIG. 6) on skin 22, creating closed end 31 by an inset 46. Back plate appendage 25 is removably fastened to skin 22 with a back plate appendage to skin mechanical fastener 56.

FIG. 6 shows slots 34 as preferably seven rectangular cutouts in skin 22. Tab 32 in FIG. 4 comprises preferably seven multi-faceted geometric shapes protruding radially from the perimeter of back plate 24. FIG. 2A is an enlarged view showing tab 32 and slot 34 as a tab and slot mechanical fastener 58, proportioned to fit with clearance to allow assembly. FIG. 2B is an enlarged view showing tab 32 slot 34 with a mini tab 33 bent into its locked position.

FIGS. 1 and 5 show tube connection plate 26, a u-shaped channel, formed from metal that is preferably 0.075 inches thick. FIG. 1 shows tube connection plate 26 atop skin 22 and overlaying a seam 47 formed by two free ends of skin 22. Tube connection plate 26 is removably fastened to skin 22 by a tube connection plate to skin mechanical fastener 54.

FIGS. 1, 2 and 3 show handle mounting tube 28 formed from metal with a wall thickness of preferably 0.0625 inches. FIGS. 1-2 show handle mounting tube 28 removably fastened to tube connection plate 26 by a tube connection plate to handle mounting tube mechanical fastener 52 and back plate appendage 25 by a back plate appendage to handle mounting tube mechanical fastener 50 preferably 0.25 inches in diameter. Handle 42 is preferably constructed of fiberglass tube with a 0.100 inch wall thickness and is preferably 48 inches long with a preferable diameter of 1.2 inches removably fastened to handle mounting tube 28 with mechanical fastener 50. FIGS. 8A-8D show handle 42 extended at an approximately 55 degree angle relative to head 20.

FIG. 7 details mechanical fasteners 50, 52, 54, 56, and 58. FIG. 7A shows an enlarged view of mechanical fasteners 52, 54, and 56.

FIG. 1 is the best illustration for a summary of the connection means. It can be seen that handle mounting tube 28 is removably fastened to both back plate appendage 25 and tube connection plate 26 with mechanical fasteners 50 and 52 respectively. Back plate appendage 25 is removably fastened to skin 22 by mechanical fasteners 56. Tube connection plate 26 is removably fastened to skin 22 by mechanical fasteners 54. Handle 42 is removably inserted into handle mounting tube 28 and removably fastened with mechanical fastener 50.

Operation

The operation of this preferred embodiment is illustrated in FIGS. 8A, 8B, 8C, and 8D.

FIG. 8A

Handle 42 is placed in a forward position in proportion to the user's reach. The user grips handle 42 closest to the end opposite the head and places a penetration point 36 (shown larger on FIG. 1) on a medium 38. The user, while maintaining a grip on handle 42, applies light foot pressure to back plate 24 and the back plate appendage 25 (shown in FIG. 2) as head 20 is aligned over the object of interest.

FIG. 8B

While head 20 is aligned over the object of interest, the user pushes head 20 with additional foot pressure into medium 38 while steadying handle 42 with a hand. This action fills head 20 with a volume of medium 38.

FIG. 8C

The user pulls back and pushes down on handle 42 to free head 20 from medium 38, creating a scooping action between head 20 and medium 38.

FIG. 8D

Head 20 is filled with medium 38. The user grips handle 42 with both hands and dumps medium 38, or sifts medium 38 by shaking head 20. Items in medium 38 which are larger than the sifting apertures 40 (best shown in FIG. 2) will be captured inside head 20.

The phraseology and terminology "objects" as used herein is intended to include and embrace anything which is perceptible by one or more of the senses, especially something that can be seen and felt, and is not limited or restricted to metallic items.

Furthermore, the terminology and phraseology "medium" as used herein is intended to connote generally any surrounding or pervading substance in which bodies or objects exist or move, and includes, but is not limited to, sand, earth, water, dirt, mud, gravel, etc.

CONCLUSION, RAMIFICATIONS, AND SCOPE

Accordingly, the reader will see that the mechanically fastened digging and sifting scoop described has desirable features not identified in the present art. The use of mechanical fasteners without any welding for construction results in a more durable lightweight device with replaceable components. The connection means provides for the combination of high strength light-weight metal alloys, with different compositions, resulting in a durable, light-weight scoop.

It will be apparent to those skilled in the art that changes and modifications may be made in the embodiment illustrated without departing from the spirit and scope of the invention. In other embodiments head 20 shown in FIGS. 1, 2 and 7 could have a skin 22 length that could be longer or shorter and a diameter that could be larger or smaller or a combination of both. Head 20 could be any geometric shape besides tubular. Mechanical fasteners 50, 52, 54, and 56 could be shifted one way or the other, they could be smaller or larger in diameter, and their quantity could be more or less. Sifting aperture 40 quantity, placement, and diameter could vary on skin 22 and back plate 24. Skin 22 and back plate 24 could have more or less sifting apertures 40 of varying sizes.

Back plate 24 as shown in FIG. 2. could be mounted flush to the end of the skin 22, eliminating inset 46 while still creating the closed end. Tabs 32 could be bent and mechanically fastened to skin 22 eliminating the use of slots 34. Tab 32 quantity could be more or less.

Other embodiments could use different tab and slot mechanical fastener 58 configurations. Tabs 32 and slots 34 shown in FIGS. 2A and 2B could be proportionally larger or smaller, placed in various locations and their quantity could be more or less. The tabs 32 and slots 34 can be of any geometric shape.

The quantity and location of mechanical fasteners 52 and 54 on tube connection plate 26 in FIG. 1 could vary. Tube connection plate 26 could vary in size. Mechanical fastener 54 locations in the skin could be moved one way or the other, could be smaller or larger in diameter, and their quantity could be more or less.

Not illustrated but described: Handle mounting tube 28 can extend from the underside of the top of skin 22 thru a geometrically aligned hole in tube connection plate 26 for a distance of approximately 48 inches where handle mounting tube 28 can be used as a handle. Handle mounting tube 28 length's and diameter can vary. Handle mounting tube 28 can be removably fastened by a mechanical fastener located under the top surface of skin 22. Mechanical fastener locations 50 and 52 on the handle mounting tube 28 can be moved one way or the other, they can be smaller or larger in diameter and their quantity can be more or less.

Various mechanical fastener means can be used such as, but not limited to: bonding with adhesive; screwing; clinching; bordering; folding; bolting; riveting. Mechanical fastener locations can be added, removed or moved. They can be round, square or any other geometric shape and of any diameter and size.

The components of a mechanically fastened digging and sifting scoop can be made from a variety of materials such as, but not limited to: carbon steel; stainless steel; carbon fiber; fiberglass; aluminum, titanium; plastic. Suitable isolation material can be used between components to prevent any potential galvanic corrosion.

With details and embodiments of the present invention for a mechanically fastened sifting scoop disclosed, it will be appreciated by one skilled in the art that numerous changes and additions could be made thereto without deviating from the spirit or scope of the invention. Accordingly, the scope of the invention should be determined not by the embodiment illustrated, but by the appended claims and their legal equivalents.

We claim:

1. A combination digging and sifting scoop comprising:

a head wherein said head has a plurality of sifting apertures;

a handle for manipulating said head;

said head comprising a skin, a back plate, a back plate appendage, a tube connection plate, a handle mounting tube, and a plurality of mechanical fasteners;

said head has one open end and one closed end;

said skin comprises a body formed from a flat piece of material whereby two opposite ends become adjacent and thereby form a seam;

said back plate forms said closed end wherein said back plate is inset into the rear leading edge of said skin wherein said back plate has at least one tab that protrudes through at least one slot in said skin and wherein said back plate further comprises an appendage that extends from said closed end of said skin and fastens to said handle mounting tube;

said tube connection plate is a u-shaped channel wherein said tube connection plate is positioned over/atop said seam formed in said skin;

said mechanical fasteners removably fasten said handle mounting tube, said back plate appendage, said tube connection plate, said handle, and said skin;

whereby the combination digging and sifting scoop allows the combination of materials to be mechanically fastened together.

2. The combination digging and sifting scoop of claim 1, wherein: said skin is made of at least metal and is at least between 0.0625 and 0.375 inches thick.

3. The combination digging and sifting scoop of claim 1, wherein: said handle is comprised of at least metal, wood, plastic tubing, foam filled plastic tubing, fiberglass, composite material and wherein said handle is comprised of varying lengths and cross-sectional shapes including round, oval, square, rectangular, or triangular.

4. The combination digging and sifting scoop of claim 1, wherein: said tabs have a bendable mini tab.

5. The combination digging and sifting scoop of claim 1, wherein: said mechanical fasteners comprise at least bolts, washers, nuts, screws, rivets, tabs, mini tabs and slots.

6. A method of assembling a mechanically fastened digging and sifting scoop comprising:

a) positioning a skin to accept a back plate;

b) positioning said skin and said back plate so a back plate appendage is centered at a seam formed in said skin;

c) positioning tabs on said back plate to fully engage slots in said skin;

d) positioning back plate appendage mechanical fastener holes atop matching mechanical fastener holes in said skin;

e) attaching said back plate to said skin with a plurality of mechanical fasteners;

f) positioning a tube connection plate atop said seam formed in said skin and attaching said tube connection plate atop said skin with said mechanical fasteners;

g) positioning a handle mounting tube to said tube connection plate and positioning mechanical fastener holes and attaching to tube connection plate with said mechanical fastener;

h) bending mini tabs on said back plate;

i) steps a-h complete assembly of the head;

j) inserting a handle into said handle mounting tube and positioning said handle mounting tube and said handle to said backplate appendage mechanical fastener holes and attaching with said mechanical fastener;

k) attaching said back plate to said skin, attaching said tube connection plate atop said skin, attaching said handle mounting tube to said tube connection plate and said back plate appendage, attaching said handle to said handle mounting tube using said mechanical fasteners shall not include welding;

l) steps a-k complete assembly of a mechanically fastened digging and sifting scoop.

* * * * *